US008946980B2

(12) United States Patent
Baacke et al.

(10) Patent No.: US 8,946,980 B2
(45) Date of Patent: Feb. 3, 2015

(54) METHOD FOR ASSEMBLING A SOCKET FOR A DISCHARGE LAMP AND DISCHARGE LAMP

(75) Inventors: Swen-Uwe Baacke, Neuburg/Donau (DE); Gerhard Loeffler, Eichstaett (DE); Dirk Rosenthal, Gaimersheim (DE); Wolfgang Seitz, Eichstaett (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 439 days.

(21) Appl. No.: 12/994,780

(22) PCT Filed: May 29, 2008

(86) PCT No.: PCT/EP2008/056610

§ 371 (c)(1),
(2), (4) Date: Nov. 26, 2010

(87) PCT Pub. No.: WO2009/143892

PCT Pub. Date: Dec. 3, 2009

(65) Prior Publication Data

US 2011/0068673 A1 Mar. 24, 2011

(51) Int. Cl.

| | |
|---|---|
| ***H01J 5/52*** | (2006.01) |
| ***H01J 9/34*** | (2006.01) |
| ***H01J 5/54*** | (2006.01) |
| ***H01J 5/60*** | (2006.01) |
| ***H01J 61/86*** | (2006.01) |

(52) U.S. Cl.

CPC ... *H01J 9/34* (2013.01); *H01J 5/54* (2013.01); *H01J 5/60* (2013.01); *H01J 61/86* (2013.01)

USPC ..... 313/318.03; 445/24

(58) Field of Classification Search

USPC ..... 313/317–318.12

See application file for complete search history.

(56) References Cited

U.S. PATENT DOCUMENTS

| | | | | |
|---|---|---|---|---|
| 2,791,679 | A | 5/1957 | Hierholzer et al. | |
| 2,924,731 | A | 2/1960 | Martt et al. | |
| 3,205,395 | A | 9/1965 | Buchwald | |
| 3,219,870 | A | 11/1965 | Gottschalk | |
| 5,320,562 | A | 6/1994 | Moeller et al. | |
| 7,982,399 | B2 * | 7/2011 | Eijsermans | 313/623 |
| 7,999,452 | B2 | 8/2011 | Naito | |
| 2008/0137344 | A1 | 6/2008 | Lang et al. | |

FOREIGN PATENT DOCUMENTS

| | | | |
|---|---|---|---|
| CN | 1553467 | A | 12/2004 |
| DE | 688778 | C | 3/1940 |
| DE | 102005000713 | A1 | 7/2006 |

(Continued)

OTHER PUBLICATIONS

English Abstract RU2007638C1. Feb. 15, 1994.

(Continued)

*Primary Examiner* — Nimeshkumar Patel
*Assistant Examiner* — Brenitra M Lee

(57) ABSTRACT

A method for fitting a base for a discharge lamp is provided. The method may include providing a discharge lamp with an end region, on which an option is provided for making contact with an electrode located in the interior of the discharge vessel; applying material to the end region; positioning a base sleeve onto the end region with the material; and positioning a clamping ring onto the base sleeve; wherein the clamping ring is of the kind that has at least one bead.

7 Claims, 5 Drawing Sheets

(56) References Cited

FOREIGN PATENT DOCUMENTS

| | | | |
|---|---|---|---|
| GB | 259885 | A | 10/1926 |
| GB | 796454 | A | 6/1958 |
| JP | S6273461 | U | 5/1987 |
| JP | H0433246 | U | 3/1992 |
| JP | 3007102 | U | 2/1995 |
| JP | 2008311177 | A | 12/2008 |
| JP | 2009152103 | A | 7/2009 |
| KR | 201998011905 | U | 5/1998 |
| RU | 2007638 | C1 | 2/1994 |
| WO | WO2007113742 | * | 10/2007 |

OTHER PUBLICATIONS

International Search Report of PCT/EP2008/056610 mailed Apr. 23, 2009.
English machine translation of DE 688 778 C.
English abstract for CN1553467A dated Dec. 8, 2004.
English abstract for JP2009-152103 dated Jul. 9, 2009.

* cited by examiner

METHOD FOR ASSEMBLING A SOCKET FOR A DISCHARGE LAMP AND DISCHARGE LAMP

RELATED APPLICATIONS

The present application is a national stage entry according to 35 U.S.C. §371 of PCT application No.: PCT/EP2008/056610 filed on May 29, 2008.

TECHNICAL FIELD

Various embodiments provide a method for fitting a base for a discharge lamp and a discharge lamp.

BACKGROUND

A method for fitting a base for a discharge lamp in accordance with the preamble of patent claims 1 and 6 is generally known. After manufacture of the discharge vessel with electrodes placed therein and soldering of an electrode holding rod to the electrodes located in the discharge vessel in order that said electrode holding rod can act as external connection by virtue of it protruding out of an end region of the discharge vessel, for example, the discharge vessel is provided in a form without a base. It is now not possible for a base sleeve to readily be positioned onto the discharge vessel since the shape of the end region of the discharge vessel can no longer be matched perfectly to the base sleeve. Before a base sleeve is positioned onto the end region, therefore, material is applied to said end region, and this material acts as a buffer material between the base sleeve and the discharge vessel. The material should be soft. In addition to cement, a graphite strip which is wound onto the typically cylindrical end region in a plurality of layers is used for this purpose. It is also possible for a suitable ceramic material to be applied, in particular to be wound onto the end region. Once it has been positioned onto the end region with the material, the base sleeve is held on the end region by a clamping ring. The base sleeve in this case passes on the force exerted on it by the clamping ring, via the material applied to the end region, to the discharge vessel. The material applied to the end region has an important function, namely that of absorbing these forces. If the forces are too strong, the discharge vessel can be damaged, for example if it is made from glass, as is often the case. Even in the case of discharge vessels consisting of quartz glass, it is possible for stresses to occur which result in cracks and therefore permanent damage. In order to avoid such damage, it is necessary to ensure in a sensitive manner that the material is applied in a sufficient quantity, but not in an excessive quantity, on the end region. In this case, individual deviations in the design of the discharge vessels need to be taken into consideration. During the manufacturing process, it may arise that the cylindrical end region in one case has a slightly smaller diameter and in another case has a slightly larger diameter. There may also be deviations from the perfect cylinder form to the extent that the end region has a more oval cross section. If a graphite strip is wound around the end region of the discharge vessel, these individual peculiarities can be compensated for to a certain extent, for example in the first case slightly more of the strip can be wound around the end region and in the second case slightly less of the strip. Owing to the individual properties of the form of the discharge vessels, until now a base has been fitted purely by hand. Using their experience, the workers will be able to see from a discharge vessel how much material needs to be applied to the end region and in what way.

For these reasons, it has until now not been possible to automate the method for fitting a base. The process for fitting a base is therefore cost-intensive when manufacturing a discharge lamp.

SUMMARY

Various embodiments provide a method for fitting a base for a discharge lamp which can be automated.

Making use of the concepts according to various embodiments, it is possible to provide a discharge lamp, wherein the manufacture of this discharge lamp can in particular be performed in automated fashion.

In accordance with a first aspect of the invention, therefore, a clamping ring of the kind that has at least one bead, i.e. a substantially channel-shaped material extension, is positioned onto the base sleeve. Providing a clamping ring with a bead makes the clamping ring flexible, i.e. it can be adapted in terms of its shape and also in terms of its inner diameter. Given a suitable configuration of such a clamping ring, fluctuations in the shape of the discharge vessel in the region of the base can be compensated for, even if the material applied to the end region is not perfectly matched to the individual properties of the end region of the discharge vessel, for example if said material is applied to the end region in an automated process. Owing to the bead, the clamping ring yields if there are excessively strong opposing forces, and therefore no excessive force is exerted on the base sleeve and the discharge vessel. The clamping ring can even be configured such that the force exerted on the discharge vessel is always the same, even if the discharge vessel varies in terms of its shape within certain limits.

In principle, a clamping ring with a single bead, which preferably extends axially over the clamping ring, is sufficient for implementing the invention. "Axially" is in this case related to an axis which is perpendicular to a plane in which the clamping ring has a circular cross section, for example perpendicular to the center point of the circle in the circular cross section. Preferably, the clamping ring which is used in the method according to the invention has a succession of such axially extending beads over its circumference. The large number of beads ensures particularly high degree of flexibility of the clamping ring, and owing to the fact that the beads are distributed over the circumference of the clamping ring, in particular local deviations from the circular form in the cross section of the end region of the discharge vessel can easily be compensated for by the clamping ring.

In accordance with a second aspect of the invention, the material to be applied to the end region is provided in the form of a graphite ring, and this graphite ring is simply brushed over the end region. When using a graphite ring between the base sleeve and the base region of the discharge vessel, the discharge lamp can be manufactured in automated fashion. Since graphite is a very soft material, the graphite ring can absorb forces which are exerted by the clamping ring. The capacity of the graphite ring to compensate for individual deviations in terms of the shape of a discharge vessel in the end region thereof from the desired shape can be boosted further by virtue of the graphite ring being slotted (in particular being provided with an axially running slot), as a result of which it can be matched particularly well to different circumferences of the end region, and the graphite ring provided can also have at least one bead, with this bead then having the same effect as the bead on the clamping ring in the first aspect of the invention, namely that forces acting on it by virtue of the graphite ring are compensated for and distributed in such a way that the same force acts on the discharge vessel substantially continuously, even if the discharge vessel deviates from a basic or desired form, within certain limits. The bead on the graphite ring ensures effective transmission of forces, as is expedient for a force-fitting connection.

The two aspects according to the invention are combined with one another in a preferred embodiment, i.e. the graphite ring is positioned onto the end region and a clamping ring with a bead is used.

In a basic design in accordance with the preamble of patent claim 9, as is known per se, the discharge lamp according to the invention has the feature that the base sleeve is connected to the discharge vessel in a force-fitting manner. The force-fitting connection ensures that the same force is always exerted on the discharge vessel, even if the shape of said discharge vessel deviates from a basic shape, with the result that it is possible to avoid damage to the discharge vessel. The discharge lamp according to the invention can be provided with the two methods according to the invention. The force-fitting connection can be provided by virtue of the fact that a clamping ring, which has at least one bead (preferably a succession of axially extending beads over its circumference), rests on the base sleeve, and the force-fitting connection can also be produced by virtue of the fact that a graphite ring is arranged between the base sleeve and the end region, with said graphite ring preferably being slotted and additionally or otherwise preferably having at least one bead.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1A:
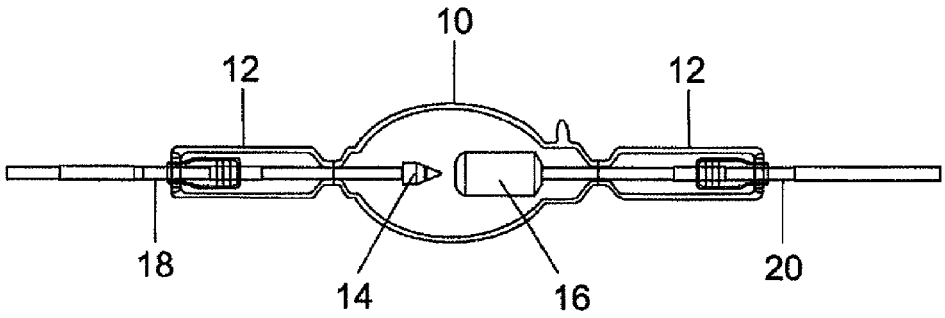
FIGS. 1A-1D show the design of a high-pressure discharge lamp during manufacture thereof in different steps of a preferred embodiment of the method according to the invention.

The method according to the invention is based on a high-pressure discharge lamp which is under construction in the state shown in FIG. 1A. Once a discharge vessel 10 has been produced from glass or quartz glass with two cylindrical shafts 12 adjoining one another on opposite sides, this state is achieved by virtue of the fact that electrode holding rods 18 and 20 have been soldered to each of the electrodes 14 and 16 located in the glass vessel 10 in order to act as the external connection for the electrodes in order thus to provide an option for making contact with the electrodes. The electrode holding rods 18 and 20 protrude out of the cylindrical shafts 12, i.e. the two end regions of the discharge vessel 10. A base will now be provided, with which the high-pressure discharge lamp can be inserted into a lampholder. An electrical contact with the electrode holding pins 18 and 20 will then be produced via the base. In the method described below, a single base is applied to the discharge vessel 10. In general, a base is fitted to each of the two shaft-shaped sides of the discharge vessel, but this is only shown for one side for reasons of simplicity.

Figure 2:
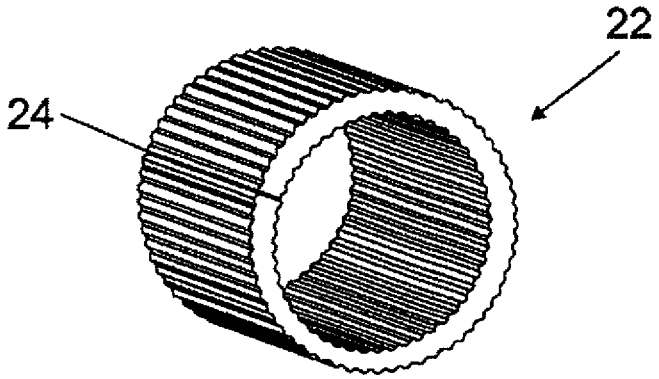
FIG. 2 shows a graphite ring used in the method according to the invention.

Starting from the state shown in FIG. 1A, a graphite ring 22, which is illustrated in a perspective view in FIG. 2, is plugged onto one of the shafts 12. The graphite ring has a virtually perfectly circular cross section, but has an axial through-slot 24. Both the inner surface and the outer surface of the graphite ring 22 are corrugated. This can be considered to be a succession of axially extending beads. By virtue of the corrugated form, the friction is increased, i.e. the graphite ring 22 rests particularly firmly on the discharge vessel 10. Specifically, forces are also compensated for particularly well. Owing to the slot 24, one and the same graphite ring can be used even in discharge vessels 10 in which the shaft 12 deviates from the basic shape, by virtue of it either not being perfectly cylindrical or it having a radius which is different than a desired radius.

Figure 1B:
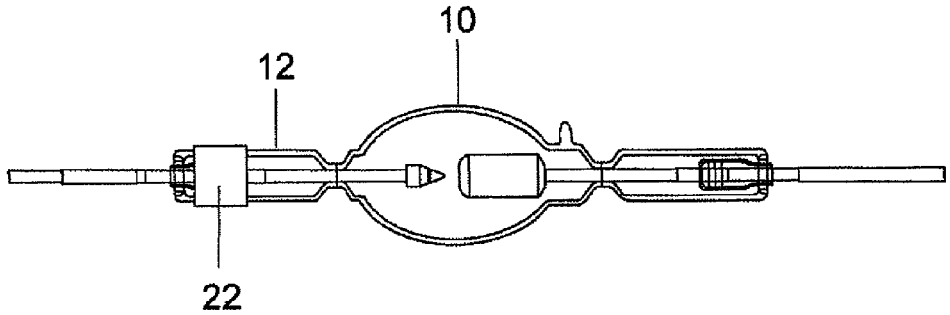
Figure 1C:
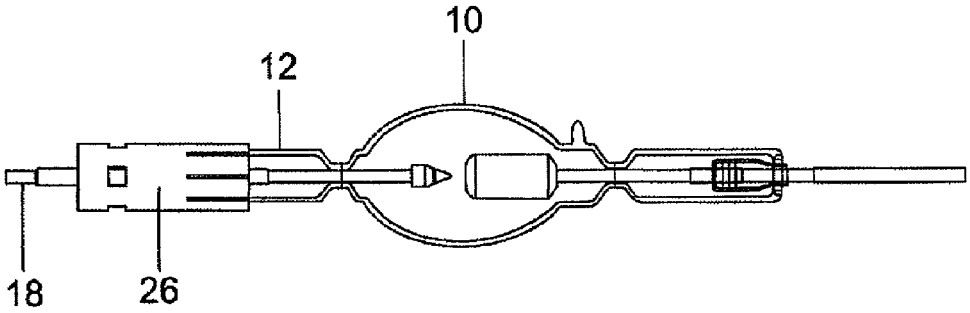
Figure 1D:
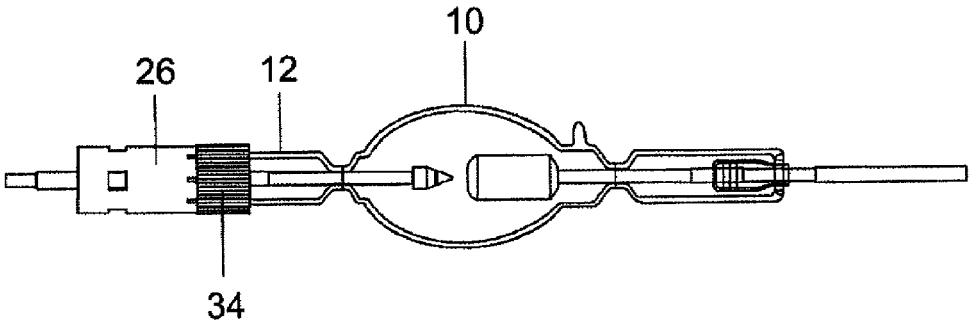
Figure 3:
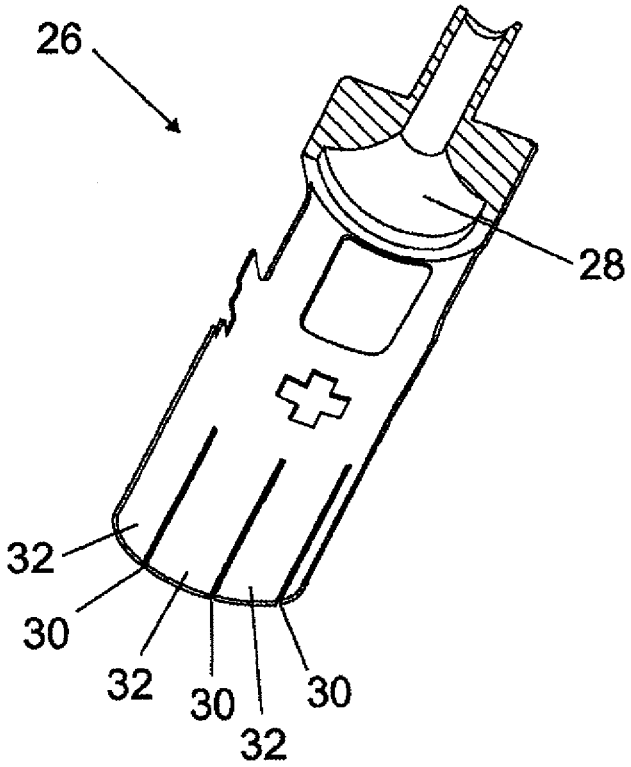
FIG. 3 shows a base sleeve (a sectional illustration of one half) used in the method according to the invention.

Starting from FIG. 1B, a base sleeve 26 (half of which is shown in FIG. 3) is now pushed onto the graphite ring. A funnel 28, which is used for guiding the electrode holding rod 18, i.e. facilitates the process of plugging the base sleeve 26 onto the discharge vessel 10 with the electrode holding rod 18, is formed in an end region of the base sleeve 26. On the opposite side, the base sleeve 26 has a circular cross section and has a succession of axial slots 30. These have the effect that individual parts such as tongues 32 can move independently of the other corresponding parts (tongues) 32. The slots 30 therefore impart increased flexibility.

Figure 4:
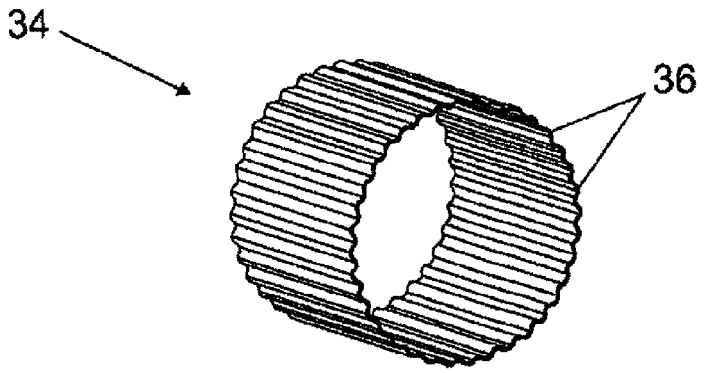
FIG. 4 shows a clamping ring used in the method according to the invention.

In order to fix the base sleeve 26 on the discharge vessel 10, a clamping ring 34, which is shown in a perspective view in detail in FIG. 4, is now positioned onto the base sleeve 26. The clamping ring 34 has a large number of axially extending beads 36. The provision of this large number of beads 36 provides the clamping ring 34 with a corrugated profile. Owing to the large number of beads 36, the clamping ring 34 is flexible. If the shaft 12 of the discharge vessel 10 should turn out to be particularly large, the clamping ring 34 yields towards the outside owing to the beads and does not exert an excessive amount of force on the shaft 12. The beads thus ensure that the contact pressure exerted by the clamping ring 34 on the base sleeve 26, the graphite ring 22 and the shaft 12 is substantially constant. For this reason, the entire manufacturing method explained with reference to FIGS. 1A to 1D can be automated.

The graphite ring 22 preferably includes pure graphite with a density of 1.4 g/cm$^3$, the base sleeve 26 includes nickel-plated steel, and the clamping ring 34 includes brass (CuZn37).

Even the provision of the graphite ring 22 on its own when using a clamping ring without a bead or conversely the provision of the clamping ring 34 with the beads 36 on its own without the use of a graphite ring in the manner of the graphite ring 22 ensures a force-fitting connection between the base sleeve 26 and the shaft 12 of the discharge vessel 10. If, as in the present case, both measures are implemented at the same time, the force-fitting connection can be configured in optimum fashion and can be ensured even in the event of considerable deviations in the shape of the shaft 12 from the desired shape.

Figure 5A:
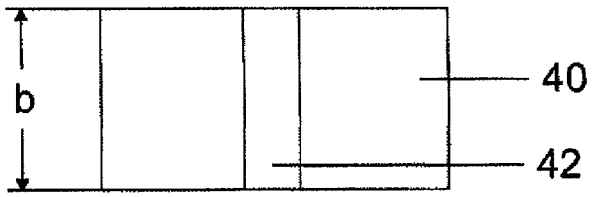
FIGS. 5*a* and 5*b* show a clamping ring with a bead in a side and end view, respectively.
Figure 5B:
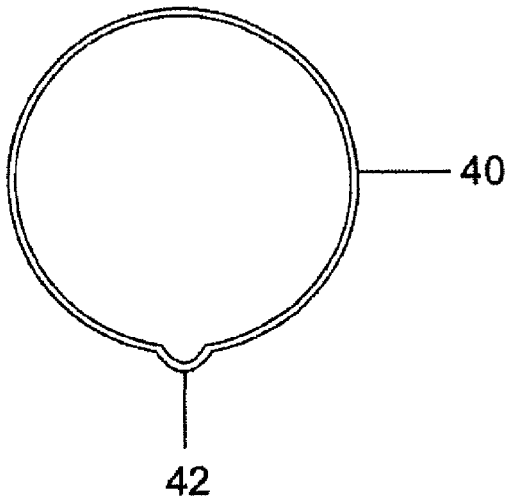

FIGS. 5*a* and 5*b* illustrate a clamping ring 40 according to the invention with a width B with only one bead 42 in a side view and in an end view, respectively. The bead 42 is turned outwards, i.e. away from the interior of the clamping ring. As a result, a local increase in the force of pressure in the direction of the lamp shaft is avoided. The clamping ring 40 consists of nickel-plated brass (CuZn37) with a wall thickness of 0.75 mm.

Figure 6:
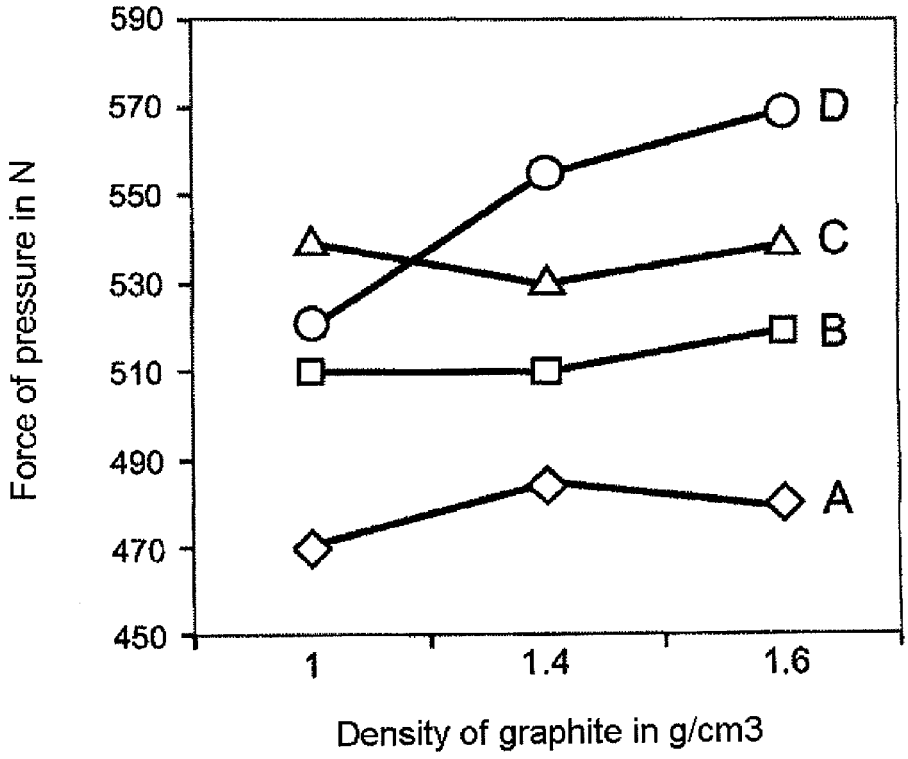
FIG. 6 shows the graphical representation of measured values for the clamping ring shown in FIGS. 5*a* and 5*b* in comparison with a standard clamping ring.

FIG. 6 shows the measurement results of the clamping ring illustrated in FIGS. 5*a* and 5*b* with a bead and three different widths A, B, C in comparison with a standard clamping ring D without any beads. The measured force of pressure is plotted on the Y axis in newtons (N) and the density of the graphite ring is plotted on the X axis in g/cm$^3$. The width b of the clamping ring 40 according to the invention is 15 mm in case A, 20 mm in case B and 25 mm in case C. As can be seen from the measured values, the force of pressure remains virtually constant within the measurement tolerances, i.e. the bead 42 of the clamping ring 40 according to the invention largely compensates for the increased density and therefore reduced flexibility of the graphite ring. In the case of the standard clamping ring, however, the force of pressure increases with increasing graphite density and therefore the risk of damage to the lamp vessel in the base region increases.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for fitting a base for a discharge lamp, the method comprising: providing a discharge vessel with an end region, on which an option is provided for making contact with an electrode located in the interior of the discharge vessel; applying material to the end region; positioning a base sleeve onto the end region with the material; and positioning a clamping ring onto the base sleeve; wherein the clamping ring is of the kind that has at least one bead, wherein the material is provided in the form of a graphite ring, which is brushed over the end region.

2. The method as claimed in claim 1, wherein the clamping ring is of the kind that has a succession of axially extending beads over its circumference.

3. The method as claimed in claim 1, wherein the graphite ring provided is slotted.

4. The method as claimed in claim 1, wherein the graphite ring provided has at least one bead.

5. A method for fitting a base for a discharge lamp, the method comprising: providing a discharge lamp with an end region, on which an option is provided for making contact with an electrode located in the interior of the discharge vessel; applying material to the end region; positioning a base sleeve onto the end region with the material; positioning a clamping ring onto the base sleeve; wherein the material is provided in the form of a graphite ring, which is brushed over the end region.

6. The method as claimed in claim 5, wherein the graphite ring provided is slotted.

7. The method as claimed in claim 5, wherein the graphite ring provided has at least one bead.

* * * * *